United States Patent [19]

Noda

[11] 4,420,858

[45] Dec. 20, 1983

[54] DEVICE FOR ADJUSTING THE LENGTH OF A BAND OR THE LIKE

[75] Inventor: Taizo Noda, Hyogo, Japan

[73] Assignee: Kohshoh Limited, Kyoto, Japan

[21] Appl. No.: 223,767

[22] Filed: Jan. 9, 1981

[30] Foreign Application Priority Data

Jan. 14, 1980 [JP] Japan ..... 55-2794

[51] Int. Cl.[3] ..... A44B 11/06

[52] U.S. Cl. ..... 24/170; 24/191; 24/309

[58] Field of Search ..... 24/170, 191, 192, 193, 24/206 R, 309, 319

[56] References Cited

U.S. PATENT DOCUMENTS

| | | | |
|---|---|---|---|
| 396,266 | 1/1889 | Cheesman | 24/192 |
| 446,840 | 2/1891 | Richards | 24/319 |
| 3,042,986 | 7/1962 | Racette et al. | 24/170 |
| 3,852,855 | 12/1974 | Bengtsson | 24/170 X |

*Primary Examiner*—Robert P. Swiatek

*Attorney, Agent, or Firm*—Fidelman, Wolffe & Waldron

[57] ABSTRACT

A device for adjusting the length of a band or the like which comprises a first and a second component member. The first component member comprises an annular body having a passage of substantially rectangular cross section for a portion of the band to be passed through and a bearing slot or recess formed in the bottom wall of the body. The second component member comprises a plate having an upstanding end portion the upper edge of which is preferably serrated and a depending tongue adjacent to the end portion thereof. When the first and second component members are connected, the tongue of the second component member engages the bearing slot or recess of the first component member to securely fasten said portion of the band between the upper edge of the upstanding end portion of the second component member and the inner surface of the top wall of the first component member.

12 Claims, 14 Drawing Figures

DEVICE FOR ADJUSTING THE LENGTH OF A BAND OR THE LIKE

BACKGROUND OF THE INVENTION

This invention relates to a device for adjusting the length of a strip of material such as a belt, a band, a shoulder strap or the like to be worn or used on trousers, skirts, undergarments or the like.

Various types of such devices have been proposed. One of the most commonly used types comprises a combination of two component members. One of the component members comprises a rectangular metal plate having its opposite lateral portions bent in such a manner that a central cover portion and a pair of opposite side portions perpendicular thereto are formed, with a bearing hole formed in each of the side portions, while the other component member comprises a rectangular metal plate having an end portion bent substantially perpendicularly to the remaining main portion of the plate, with a pair of pivot pins projecting laterally from the opposite lateral edges of the bent portion so as to be received in the bearing hole of the first component member.

The disadvantages of this type of buckle are that since the two component members are made of rigid material which lacks resiliency, repeated movement of the second relative to the first component member causes deformation of the bearings thereby to reduce the force to fasten and hold the band, and that the outer ends of the pivot pins laterally projecting from the opposite sides of the buckle not only make its appearance bad but also are likely to damage the clothes of the wearer.

In an effort to overcome the above-mentioned disadvantages of the known type of buckle, the present inventor has studied various designs of buckles while conducting many experiments and found out that by changing the positional relation between the pivot pins and the bearing it is possible to avoid the above-mentioned defects of the conventional device.

SUMMARY OF THE INVENTION

The primary object of the invention is therefore to provide a device for adjusting the length of a belt, a band, a shoulder strap or the like to be worn or used on trousers, skirts, undergarments, or the like, which is substantially improved in design, construction and appearance.

Another object of the invention is to provide such a device as aforesaid which is capable of fastening a belt, a band, a shoulder strap or the like without fail even after long repeated use thereof.

Another object of the invention is to provide such a device as aforesaid which is quite unlikely to damage the clothes or garments of the wearer.

Another object of the invention is to provide such a device as aforesaid, which makes it easier to attach or fix a belt, a band, a shoulder strap, or the like member to the device than in the previously mentioned conventional buckle.

Still another object of the invention is to provide such a device as aforesaid which can be manufactured simply, easily and inexpensively.

The invention with its above-mentioned and other features and advantages will become apparent from the following detailed description of some preferred embodiments thereof with reference to the accompanying drawings.

DETAILED DESCRIPTION OF PREFERRED EMBODIMENTS

Figure 1:
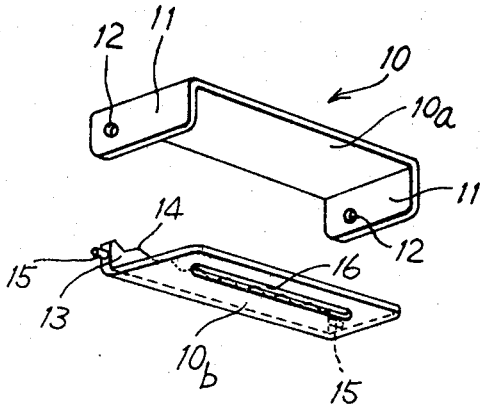
FIG. 1 is an exploded view of a conventional prior art buckle.

Referring to the drawings, first to FIG. 1, a conventional buckle 10 is shown comprising a first component member 10*a* and a second component member 10*b* pivotally connected to the first component member. The first component member 10*a* is made of a rectangular metal plate by bending the opposite lateral portions 11 of the plate perpendicularly to the remaining main portion thereof. A bearing hole 12 is formed in each of the side walls 11 of the first component member.

The second component member 10*b* is also made of a rectangular metal plate, one end portion of which is bent substantially perpendicularly to the main portion of the plate to form an upstanding wall 13 the upper edge of which is serrated as at 14. The upstanding wall 13 is provided at each of the opposite lateral edges thereof with a pivot pin 15 laterally projecting therefrom.

A slot 16 is formed in the end of the second component member 10*b* opposite to the upstanding wall 13 for a looped end of a belt to be attached through the slot to the second component member in any known manner.

As is well known, the two component members 10*a* and 10*b* are combined by engagement of the pivot pins 15 of the second component member in the bearing holes 12 of the first component member. The construction has the previously described defects and disadvantages.

Figure 2:
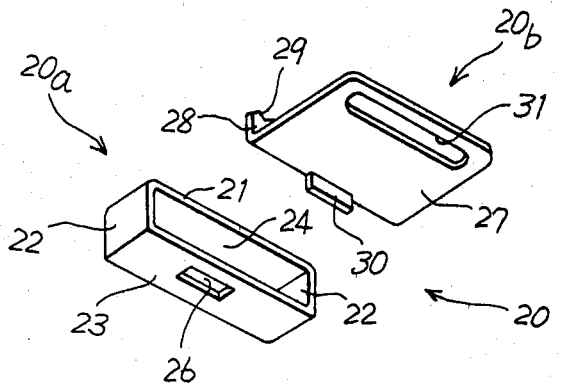
FIG. 2 is an exploded view of one embodiment of the invention.

Turning to FIG. 2, there is shown a buckle generally designated at 20 constructed in accordance with the invention. The buckle 20 comprises a first component member 20*a* and a second component member 20*b* operatively connected to the first component member as will be described in detail presently.

Figure 3:
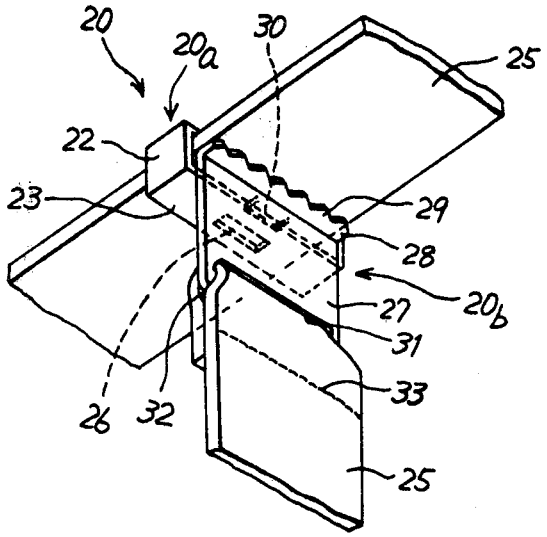
FIG. 3 is a perspective view of the device of FIG. 2, while it is opened.
Figure 4:
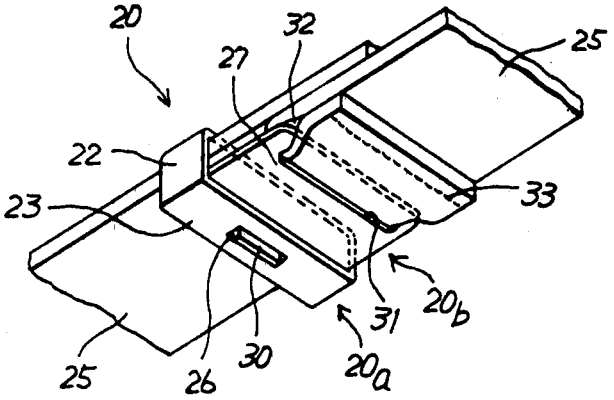
FIG. 4 is a view similar to FIG. 3 showing the device closed.

The first component member 20a comprises an annular body made of a top wall 21, a pair of opposite side walls 22, and a bottom wall 23 and having a passage 24 rectangular in transverse cross section, through which a belt 25 or the like is to be passed as shown in FIG. 3 or 4. A bearing hole 26 is formed in the middle of the bottom wall 23.

The second component member 20b is a plate 27 having one end portion 28 thereof bent upright substantially perpendicularly to the remainder of the plate. The upper edge of the bent portion 28 is serrated as at 29 and a tongue 30 is provided on the undersurface of the plate 27 near the upright portion 28 so as to depend from the plate 27 substantially perpendicularly thereto.

A slot 31 is formed in the plate member 27 adjacent to the end thereof opposite to the upright bent portion 28. As shown in FIG. 3 or 4, one end of the band 25 is attached to the second component member 20b by inserting the end portion of the band through the slot 31 and forming a loop 32 of the end portion and fixing it by stitching as at 33 or any other conventional method.

Figure 5:
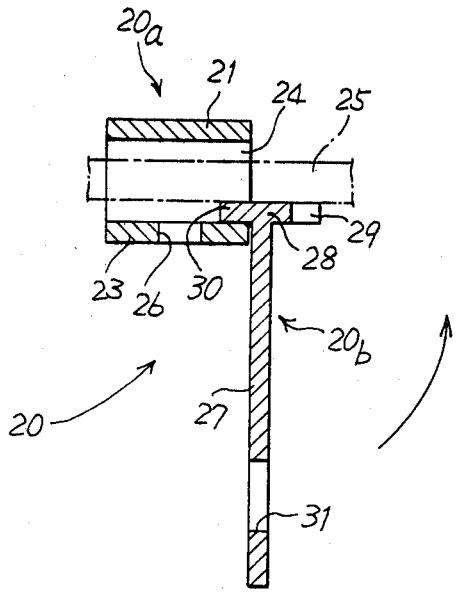
FIG. 5 is an enlarged view in longitudinal section of the device in open condition.

The plate 27 of the second component member 20b has a width a little smaller than the inner width of the passage 24 of the first component member 20a. The two component members 20a and 20b are connected or combined in the following manner. The band 25 one end of which is fixed to the second component member 20b in the above-mentioned manner has a portion inserted through the passage 24 of the first component member 20a. The second component member 20b is held adjacent to the first component member 20a substantially perpendicularly thereto with the upstanding portion 28 thereof beneath the belt 25 substantially in parallel therewith, and the tongue 30 extending into the passage 24 as shown in FIGS. 3 and 5.

Figure 6:
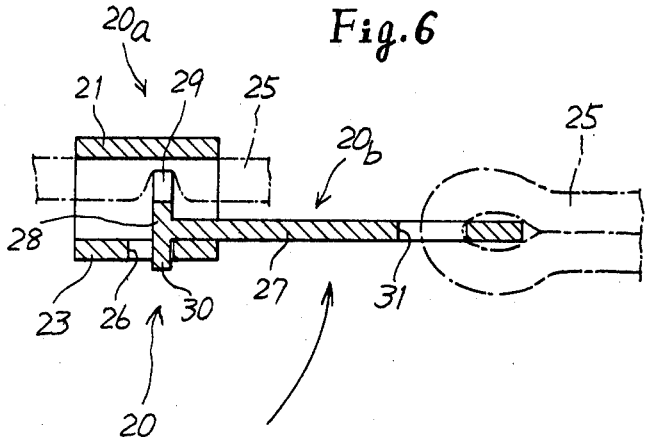
FIG. 6 is a view similar to FIG. 5 but showing the device in closed condition.

From this position, the second component member 20b is turned counterclockwise until the tongue 30 engages the bearing slot 26 in the bottom wall 23 of the first component member 20a, whereupon the belt 25 is securely clamped between the serrated edge 29 of the upstanding portion 28 of the second component member 20b and the inner surface of the top wall 21 of the first component member 20a as shown in FIG. 4 or 6.

Figure 7:
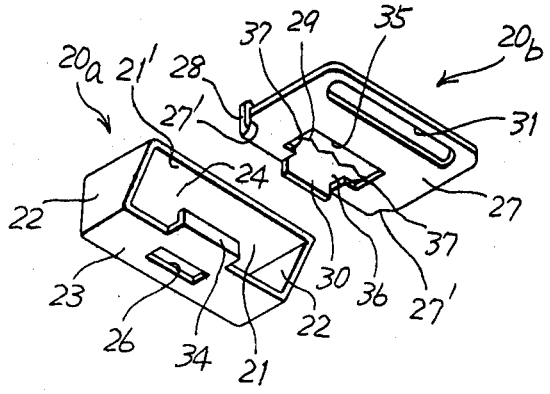
FIG. 7 is an exploded view of another embodiment of the invention.

FIG. 7 shows a second embodiment of the invention, wherein the same reference numerals as in FIGS. 2 through 6 designate the corresponding parts. In FIG. 7 the top wall 21 of the first component member 20a has a longer axial length than the bottom wall 23 thereof, so that the opposite lateral walls 22 have a trapezoid shape. The overhanging portion 21' of the top wall 21 serves as a guide surface which makes movement of the second component member 20b easier than otherwise while the buckle is in use.

The width of the plate 27 of the second component member 20b is substantially the same as the outer width of the first component member 20a. Therefore, the width of the upstanding portion 28 of the plate 27 and the end portion thereof adjoining the lower end of the upstanding portion 28 are made a little smaller than the inner width of the passage 24 of the first component member 20a, so that a pair of shoulders 27' are formed at the opposite outer sides of the end portion of the plate 27. This arrangement enables the upstanding portion 28 of the second component member 20b to be disposed inside the passage 24 of the first component member 20a when the two component members 20a and 20b are connected.

An upstanding edge 34 is formed on the front end of the bottom wall 23 of the first component member 20a in the middle portion of the width thereof. The edge 34 helps prevent the second component member 20b from being disengaged from the first component member 20a when the second component member 20b is brought into the position perpendicular to the first component member 20a as shown in FIG. 8 while the buckle is in use.

An opening 35 is formed in the plate 27 of the second component member 20b adjacent to the depending tongue 30. The opening 35 is generally rectangular and has a width a little greater than that of the upstanding edge 34 of the first component member 20a, with a recess 36 formed in one side of the opening 35 leaving a pair of shoulders 37 at the opposite sides.

When the two component members 20a and 20b are connected, the upstanding edge 34 of the first component member 20a engages the opening 35 of the second component member 20b, with the shoulders 37 engaging the opposite lateral ends of the upstanding edge 34 thereby to prevent inadvertent separation of the two component members while the buckle is in use.

Figure 8:
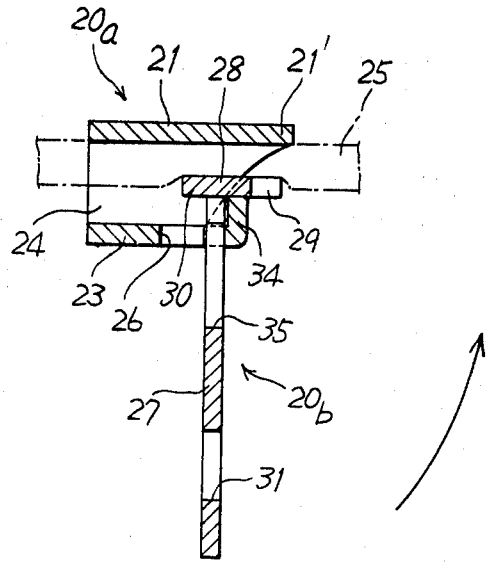
FIG. 8 is an enlarged view in longitudinal section of the device in open condition.
Figure 9:
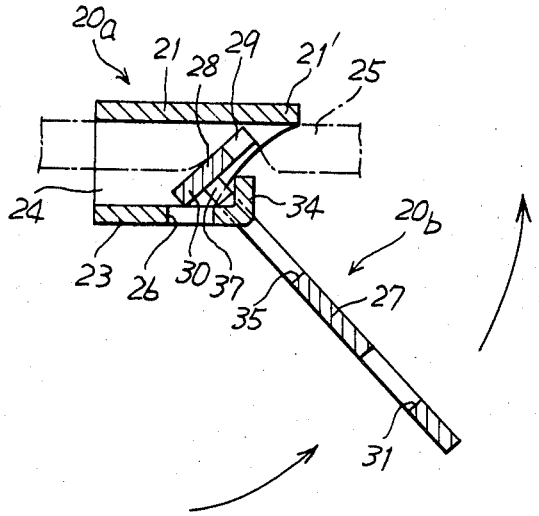
FIG. 9 is a view similar to FIG. 9 but showing the device in partially closed condition.
Figure 10:
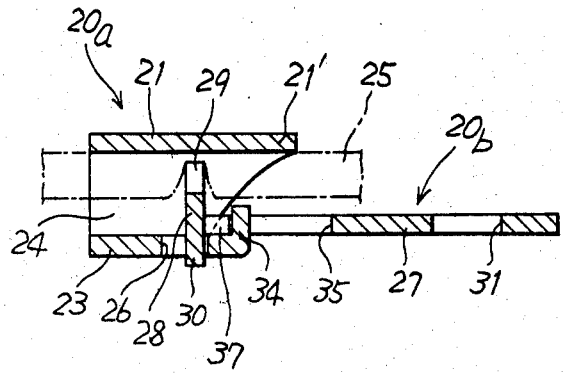
FIG. 10 is a view similar to FIG. 9 but showing the device in closed condition.

The operation of the second embodiment is substantially the same as that of the first embodiment and will be easily understood by reference to FIGS. 8, 9 and 10 so that no further explanation will be needed.

Figure 11:
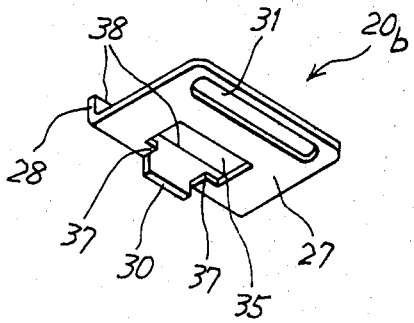
FIG. 11 is a view similar to FIG. 7 showing a modified form of the second component member only.

In the previously described embodiments the upper edge of the upstanding portion 28 of the second component member 20b is serrated. No such serrations may be provided on the upper edge which is linear as shown at 38 in FIG. 11.

Figure 12:
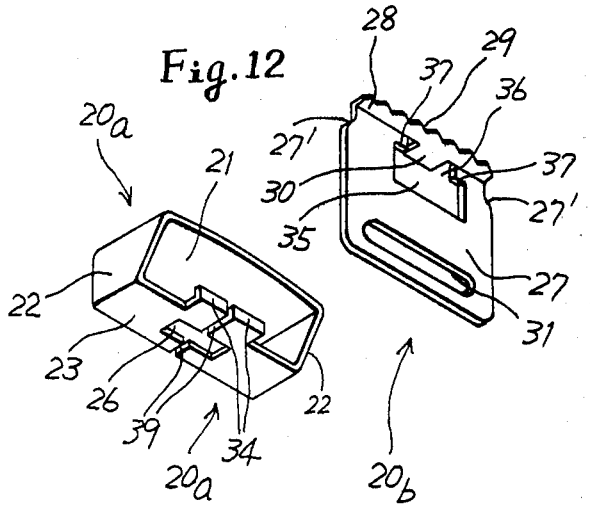
FIG. 12 is an exploded view of a third embodiment of the invention.

The bottom wall 23 of the first component member 20a may be provided with a slit 39 extending the full axial length of the first component member, as shown in FIG. 12. The slit 39 is necessarily formed when the first component member 20a is made by bending a sheet of metal into the illustrated annular shape.

Figure 13:
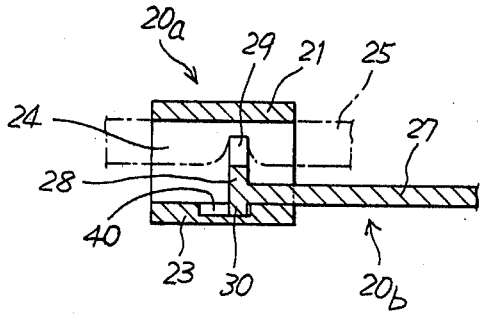
FIG. 13 is a view similar to FIG. 6 but showing a fourth embodiment of the invention.
Figure 14:
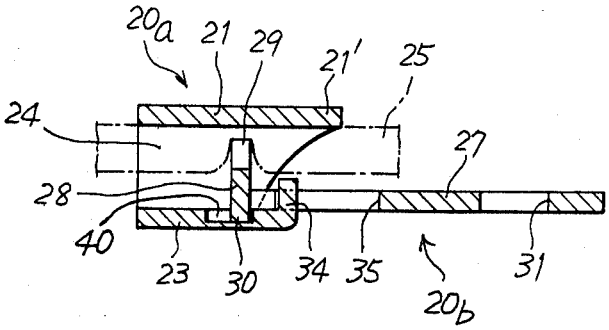
FIG. 14 is a view similar to FIG. 10 but showing a fifth embodiment of the invention.

The bearing slot 26 in the illustrated embodiments may be replaced by a recess 40 formed in the inner surface of the bottom wall 23 of the first component member 20a as shown in FIGS. 13 and 14 so that the depending tongue 30 of the second component member 20b may engage the recess 40 when the buckle is closed. The tongue 30 is shorter here than in the previous embodiments.

The shape of the first component member 20a is not limited to those illustrated but may be any other suitable shape, provided that the member 20a has a passage therethrough having a substantially rectangular transverse section. The two component members 20a and 20b may be made of any other suitable material than metal. For example they may be of a suitable plastic material.

The device of invention has various advantages such as follows: Since the slot 26 or recess 40 functioning as a bearing is formed in the bottom wall 23 of the first component member 20a, when the second component member 20b is rotated relative to the first component member so as to clamp a portion of the band 25 therebetween, a downwardly directed force is exerted on the middle portion of the bottom wall 23 to flex the portion downwardly, and when the band 25 has been completely clamped, the flexed portion is restored to the original condition. Since the resiliency does not act after the clamping has been finished, it is possible to keep the band securely clamped.

Since the device of the invention has no such laterally projecting pivot pins as are provided in conventional buckles, the device has a good appearance with little or no danger of damaging the clothes of the wearer.

Since it is possible to fix or attach one end of a band to the second component member of the device while it is separated from the first component member, the fixing work becomes easier than if the two components are unseparably connected.

What I claim is:

1. A device for adjusting the length of a strip of material such as a band, a belt, a shoulder strap or the like; comprising a first component member and a second component member detachably connected to said first component member; said first component member comprising a passage for said strip to be inserted through and bearing means, an annular body made of a top wall, a pair of opposite side walls and a bottom wall and so shaped as to define said passage, and said second component member comprising a plate member, one end portion of which is bent substantially perpendicularly to the remainder of said plate member, said second component member having a portion disposed inside said passage of said first component member when said second component member is connected to said first component member, said portion of said second component member comprising first means cooperating with said bearing means of said first component member thereby to connect said first and second component members so that said second component member can be moved between a first and a second position relative to said first component member, and second means for engaging a portion of said strip to securely fasten the same when said second component member is in one of said first and second positions, said second component member further comprising a tongue provided on said plate member adjacent to said bent portion and extending in a direction substantially opposite to said bent end portion, and a slot formed in the opposite end portion of said plate member for attaching one end of said strip to said second component member.

2. The device of claim 1, wherein said passage has a substantially rectangular transverse cross section.

3. The device of claim 2, wherein corners of said rectangular transverse cross section of said passage are rounded.

4. The device of claim 1, wherein said top wall and bottom wall are of substantially the same axial length.

5. The device of claim 1, wherein said top wall is of a greater axial length than said bottom wall.

6. The device of claim 1, wherein said bearing means comprises a slot formed in said bottom wall so that said tongue engages said slot to detachably connect said first and second component members.

7. The device of claim 1, wherein said bearing means comprises a recess formed in the inner surface of said bottom wall so that said tongue engages said recess to detachably connect said first and second component members.

8. The device of claim 1, further including an upstanding stopper formed on one edge of said bottom wall of said first component member, and an opening formed in said plate member adjacent to said tongue so that said stopper engages said opening when said first and second component members are connected.

9. The device of claim 1, wherein said first and second component members are made of metal.

10. The device of claim 1, wherein said first and second component members are made of synthetic resin.

11. The device of claim 1, wherein the outer edge of said bent portion of said plate member is linear.

12. The device of claim 1, wherein the outer edge of said bent portion of said member is serrated.

* * * * *